US005555621A

United States Patent [19]

Tanabe et al.

[11] Patent Number: 5,555,621

[45] Date of Patent: Sep. 17, 1996

[54] METHOD OF PRODUCING A CATALYTIC CONVERTER

[75] Inventors: Hiroshi Tanabe; Tsutomu Imamura; Katsumi Amada; Yuji Shimada, all of Tokyo, Japan

[73] Assignee: Calsonic Corporation, Tokyo, Japan

[21] Appl. No.: 270,827

[22] Filed: Jul. 5, 1994

Related U.S. Application Data

[62] Division of Ser. No. 145,177, Nov. 3, 1993, abandoned.

[30] Foreign Application Priority Data

| | | | |
|---|---|---|---|
| Mar. 11, 1993 | [JP] | Japan | 5-050659 |
| Mar. 22, 1993 | [JP] | Japan | 5-012845 U |
| Mar. 24, 1993 | [JP] | Japan | 5-065381 |

[51] Int. Cl.[6] ..... B23P 15/00

[52] U.S. Cl. ..... 29/890; 422/179

[58] Field of Search ..... 29/890, 422, 463, 29/464, 505; 422/174, 179, 180

[56] References Cited

U.S. PATENT DOCUMENTS

| | | | |
|---|---|---|---|
| 4,142,864 | 3/1979 | Rosynsky et al. | 422/179 |
| 4,143,117 | 5/1979 | Gaysert | 422/180 |
| 4,161,509 | 7/1979 | Nowak | 422/180 |
| 4,239,733 | 12/1980 | Foster et al. | 422/179 |
| 4,353,873 | 10/1982 | Noritake et al. | 422/179 |
| 4,504,294 | 3/1985 | Brighton | 422/179 |
| 4,521,947 | 6/1985 | Nonnenmann et al. | 29/890 |
| 4,909,994 | 3/1990 | Nishizawa et al. | 422/179 |
| 5,073,432 | 12/1991 | Horikawa et al. | 502/527 |
| 5,094,074 | 3/1992 | Nishizawa et al. | 422/174 |
| 5,302,355 | 4/1994 | Fujikura et al. | 422/180 |

FOREIGN PATENT DOCUMENTS

| | | |
|---|---|---|
| 55-64111 | 5/1980 | Japan . |
| 191818 | 12/1982 | Japan . |
| 57-191818 | 12/1982 | Japan . |
| 58-37916 | 3/1983 | Japan . |
| 108225 | 7/1983 | Japan . |
| 58-108225 | 7/1983 | Japan . |
| 80371 | 1/1990 | Japan . |
| 2-3015 | 1/1990 | Japan . |

*Primary Examiner*—Irene Cuda
*Attorney, Agent, or Firm*—Foley & Lardner

[57] ABSTRACT

A method of making a catalytic converter for an automotive internal combustion engine comprises a cylindrical honeycomb catalyst carrier made of a ceramic and carrying a catalytic material. The catalyst carrier is encased within a cylindrical container upon being axially supported at its opposite end faces between oppositely disposed annular metal caps through cushioning materials. The metal caps are fixedly secured to the inner peripheral surface of the container by plug welding. In production of the catalytic converter, the plug welding is made in a state in which the metal caps are being biased to the catalyst carrier at a predetermined pressure by a pair of pressing jigs which respectively abut the metal caps.

9 Claims, 8 Drawing Sheets

METHOD OF PRODUCING A CATALYTIC CONVERTER

This application is a divisional of application Ser. No. 08/145,177 filed Nov. 3, 1993, abandoned.

BACKGROUND OF THE INVENTION

1. Field of the Invention

This invention relates to improvements in a catalytic converter including a ceramic catalyst carrier to be used to purify exhaust gas from an internal combustion engine and in a method of producing the catalytic converter. More particularly, the invention relates to the improvements by which the ceramic catalyst carrier is axially supported at a predetermined or constant pressure within a metal container.

2. Description of the Prior Art

A variety of catalytic converters have been proposed and put into practical use for internal combustion engines. At typical one of them is disclosed in Japanese Utility Model Provisional Publication No. 57-191818 and schematically shown in FIG. 10. This catalytic converter includes a generally cylindrical ceramic carrier 123 which is made of a ceramic and carries a catalytic material. The ceramic carrier 123 is encased in a container 120 made of a metal. The container 120 is formed with converged section 121, 121 to support thereinside the ceramic carrier 123 through cushioning materials 122, 122 which are formed of metal wire mesh. Additionally, a supporting material 124 formed of metal wire mesh and a thermally expandable sealing material 125 are wound on the ceramic carrier 123 at the outer peripheral surface. The supporting material 124 is fitted inside the container 120.

The catalytic converter of this type has the following defects: The converged sections 121, 121 of the container 120 are formed by pressing, and therefore a distance or axial dimension between the converged sections 121, 121 are not uniform throughout products (catalytic converters). Accordingly, a supporting force for the ceramic carrier 123 cannot be maintained constant throughout the products. Additionally, the axial dimension of the ceramic carrier 123 is not uniform throughout the products. As a result, it is very difficult to encase the ceramic carrier 123 within the container 120 and maintain a constant supporting force.

In order to solve the above problem, it has been proposed to omit the converged sections 121, 121 as disclosed in Japanese Utility Model Provisional Publication No. 58-37916 and Japanese Patent Provisional Publication No. 55-64111.

A catalytic converter as disclosed in Japanese Utility Model Provisional Publication No. 58-37916 is arranged as follows: Annular metal caps are fixedly attached to the inner surface of a container made of a metal, in place of the converged section omitted, thereby determining the position of a ceramic catalytic carrier within the container. The ceramic carrier is kept or supported within the container through a foamed cushioning material formed from inorganic material, disposed between the container and the ceramic carrier.

With the catalytic converter of this type, the supporting force for the catalytic element can be prevented from being not uniform. However, even this catalytic converter has not yet solved the problem that the supporting force for the catalytic element becomes non-uniform throughout the products (catalytic converters) thereby lowering the supporting force. Furthermore, the foamed cushioning material formed from the inorganic material tends to be scattered in ambient air under flowing of gas through the catalytic converter, which is a defect of this catalytic converter. In view of the above fact, this catalytic converter requires a shield member for sealing the cushioning material from a gas flowing passage in the catalytic converter thereby preventing the cushioning material from being scattered. This unavoidably increases the number of constituting parts and steps of a production process of the catalytic converter. In addition the catalytic converter cannot prevent the cushioning material from being scattered, thus resulting in a shorter life span for the converter The catalytic converter disclosed in Japanese Patent Provisional Publication No. 55-64111 is shown in FIGS. 11 and 12 and is provided with annular metal caps 130, 130 which are fixedly attached to the inner surface of a container 134 similar to that disclosed in Japanese Utility Model Publication No. 58-37916, in order to determine the position of a ceramic catalyst carrier 131. The ceramic carrier 131 is axially securely supported by the annular metal caps 130, 130 through cushioning materials 132, 132 which are produced by an annular metal wire mesh, each interposed between each annular cap 130 and the catalyst carrier 131.

In this catalytic converter, a cylindrical cushioning material 133 is disposed between the outer peripheral surface of the ceramic carrier 131 and the inner peripheral surface of the container 134. Annular cushioning materials 132, 132 are disposed at outer peripheral portions of the opposite ends of the ceramic carrier 131. Pressing members 135 are disposed to press and connect the cylindrical cushioning material 133 and the annular cushioning material 132, 132 under incorporation of the metal caps 130, 130. When the cylindrical cushioning material 133 is located at a suitable position, the pressing member 135 and the metal cap 130 are welded to the metal container 134, thus securely encasing the ceramic carrier 131 within the metal container 133.

However, even the production of the catalytic converter in Japanese Patent Provisional Publication No. 55-64111 does not take into account the fact that the dimension of the axial length of the ceramic carrier 131 is not uniform throughout products (ceramic carriers). Accordingly, when the cylindrical cushioning material 133 is located at the suitable position, the connected pressing member and metal cap 135, 130 are welded to the metal container 134, even if any pressure is applied from the annular cushioning material 132 to the ceramic carrier 131. Consequently, a supporting force for the ceramic carrier 131 is not always constant or uniform throught the products.

SUMMARY OF THE INVENTION

It is an object of the present invention to provide an improved catalytic converter and a method of producing the same, by which drawbacks encountered in conventional similar catalytic converters can be overcome.

Another object of the present invention is to provide an improved catalytic converter and a method of producing the same, by which a catalytic element (ceramic catalyst carrier) can be effectively prevented from breaking or chipping off by vibration when in use.

A further object of the present invention is to provide an improved catalytic converter by which a catalytic element (ceramic catalyst carrier) is encased within a container under a constant or predetermined pressure applied to the catalytic element throughout products (catalytic converters).

A still further object of the present invention is to provide an improved method for producing the above catalytic converter, by which such a catalytic converter can be easily produced in mass production.

An aspect of the present invention resides in a catalytic converter comprising a container made of a metal. A catalytic element is encased within the container and includes a catalyst carrier made of a ceramic and carrying a catalytic material. A support material made of metal wire mesh is disposed between the carrier and an inner surface of the container so as to support the ceramic carrier within the container. A thermally expandable seal material is disposed between the ceramic carrier and the inner surface of the container so as to prevent gas from passing through a space between the ceramic carrier and the container. First and second annular metal caps are disposed near first and second end faces of the ceramic carrier to determine an axial location of the ceramic carrier. The first and second end faces are opposite each other in an axial direction of the ceramic carrier. Each metal cap has an annular flange section facing an outer peripheral portion of the end face, and a cylindrical section integral with the flange section. First and second cushioning materials are provided to prevent the ceramic carrier from axial movement. The first cushioning material is disposed between the first metal cap and the first end face of the ceramic carrier. The second cushioning material is disposed between the second metal cap and the second end face of the ceramic carrier. Additionally, metal deposits of plug welding are provided to fixedly connect the metal caps with the container to axially support the ceramic carrier through the cushioning materials at a predetermined pressure within the container.

Another aspect of the present invention resides in a method of producing a catalytic converter, comprising the following steps: (a) winding a support material made of metal wire mesh and a thermally expandable seal material on a catalyst carrier made of a ceramic and carrying a catalytic material; (b) disposing first and second cushioning materials respectively at peripheral portions of opposite end faces of the ceramic carrier; (c) attaching first and second annular metal caps respectively to the first and second cushioning materials so as to be located axially outside of the first and second cushioning materials, each metal cap having an annular flange section facing the peripheral portion of the end face of the ceramic carrier, and a cylindrical section integral with the flange section; (d) encasing the ceramic carrier within a container made of a metal; (e) pressing first and second annular metal caps toward the ceramic carrier by using a pressing jig; (f) maintaining the ceramic carrier in a state to be axially supported at a predetermined pressure through the first and second cushioning materials between the first and second metal caps; and (g) carrying out plug welding to weld the first and second metal caps to the container, maintaining the axially supported state of the predetermined pressure.

According to the present invention, the ceramic carrier is encased within the container in a state to be axially supported at the predetermined pressure between the opposite annular metal caps which are fixed to the container by the plug welding. Consequently, the ceramic carrier does not become rickety within the container and therefore is effectively prevented from breaking or chipping off. In other words, the ceramic carrier is encased within the container in a state to be axially supported at a constant pressure throughout products (catalytic converters). Accordingly, even if the ceramic carrier has an error in its axial dimension relative to a standard dimension, the ceramic carrier can be supported at a suitable axial pressure, thus preventing the ceramic carrier from breaking or chipping off.

BRIEF DESCRIPTION OF THE DRAWINGS

In the drawings, like reference numerals designate like elements and parts throughout all the figures, in which.

DETAILED DESCRIPTION OF THE DRAWINGS

Figure 1:
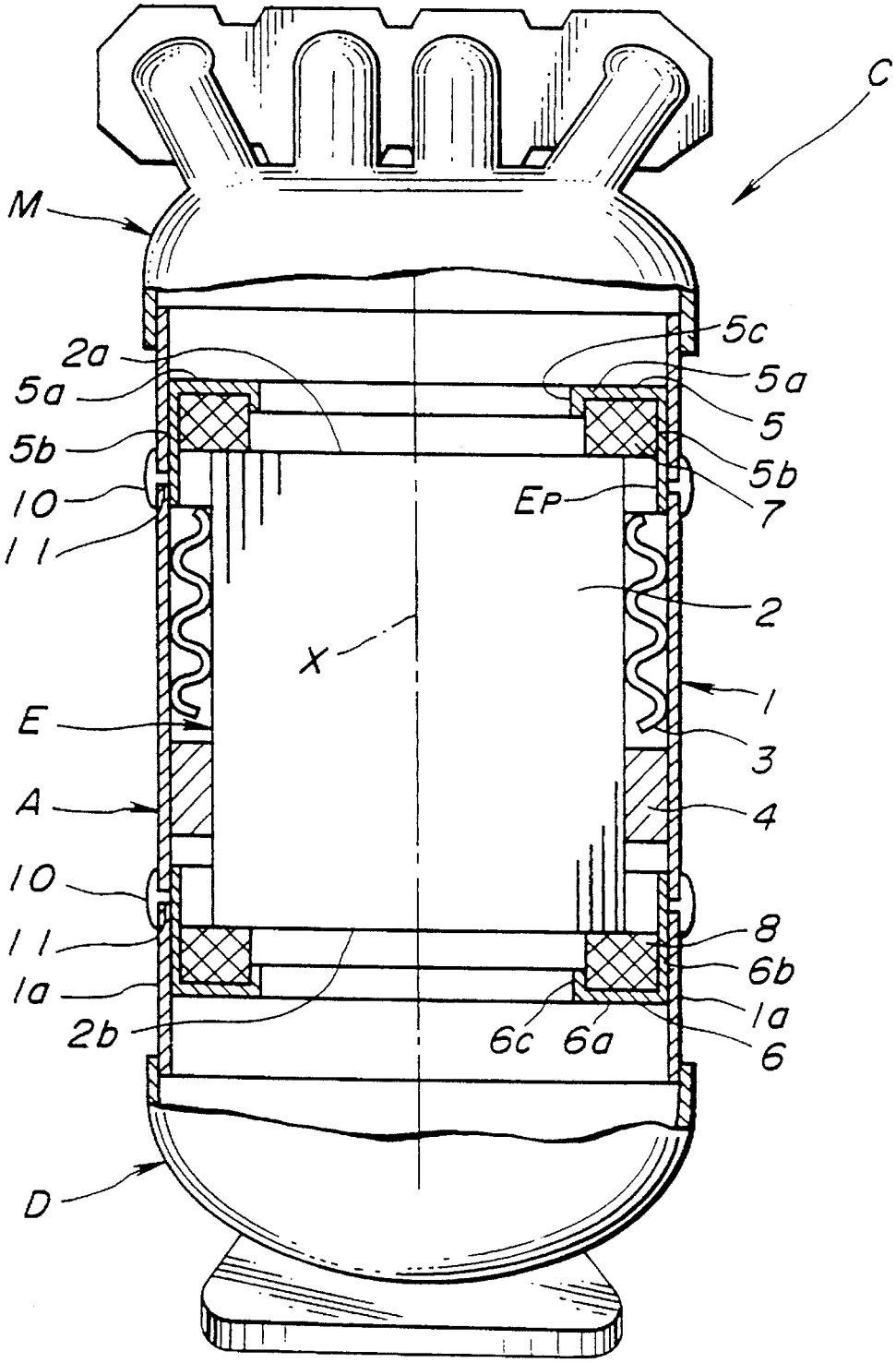
FIG. 1 is a front elevation, partly in section, of a first embodiment of a catalytic converter in accordance with the present invention.

Referring now to FIG. 1 of the drawings, a first embodiment of a catalytic converter according to the present invention is illustrated by the reference character C. The catalytic converter C of this embodiment is of the manifold type and therefore comprises an exhaust manifold M to be connected to an automotive internal combustion engine having a plurality of engine cylinders. The catalytic converter C is located generally vertical relative to a vehicle body (not shown). A catalytic converter main body A is fixedly connected at its upstream end portion to the exhaust manifold M and connected at its downstream end portion with a diffuser D. Exhaust gas from the exhaust manifold M passes through the catalytic converter main body A and discharged through the diffuser D.

The catalytic converter main body A includes a generally cylindrical container 1 made of metal. A generally cylindrical honeycomb monolithic catalytic element E is disposed within the container 1 and includes a generally cylindrical honeycomb carrier 2 made of a ceramic. A generally cylindrical support material 3 and a generally cylindrical thermally expandable seal material 4 are disposed between the surface of the ceramic carrier 2 and the inner peripheral surface of the container 1. Generally annular upstream and downstream side metal caps 5, 6 are provided to determine the axial location of the ceramic carrier 2 within the container 1. Additionally, generally annular upstream and downstream side cushioning materials 7, 8 are provided in such a manner that each is disposed between the corresponding metal cap 5, 6 and the ceramic carrier 2.

The metal container 1 includes generally semi-cylindrical two counterpart shells 1*a*, 1*a* which are fixedly secured with each other to form the cylindrical container 1. Each shell 1*a* is formed with a plurality of holes 11 for plug welding which holes 11 are located at positions corresponding to the metal caps 5, 6 which are to be fixedly secured to the inner peripheral surface of the container 1.

The ceramic carrier 2 is formed with a plurality of axially extending gas passages (not shown) each of which is coated with a catalytic material or catalyst so that the carrier 2 carries the catalytic material throughout a large surface area of the gas passages.

The support material 3 is formed of metal wire mesh which is corrugated to give it bulk. The support material 3 is wound on the cylindrical surface of the ceramic carrier 2 and fitted within the container 1.

The thermally expandable seal material 4 is made of an inorganic material and has such a characteristic as to expand under heating. The seal material 4 is available on the market under the trade name of "3M INTERAM MAT". The seal material 4 is wound on the cylindrical surface of the ceramic carrier 2 and in sealing contact with the inner peripheral surface of the container 1 thereby preventing gas from passing through a space between the ceramic carrier 2 and the container 1.

The upstream side metal cap 5 has a generally annular flange section 5*a* perpendicular to an axis X of the container 1 and of the ceramic carrier 2. A cylindrical section 5*b* is integral at its upstream side end portion with the flange section 5*a* at the outer peripheral portion and extends coaxially with the container 1. The cylindrical section 5*b* is fitted on the inner peripheral surface of the container 1 in such a manner that the downstream side portion of the cylindrical section 5*b* extends over the upstream side end face 2*a* of the ceramic carrier 2 to form an extended portion Ep. The integrally connected flange section 5*a* and cylindrical section 5*b* constitute a main body of the metal cap 5 having a L-shaped cross-section. A thin cylindrical section 5*c* is integral at its upstream side end portion with the flange section 5*a* at the inner peripheral portion. The upstream side cushioning material 7 is disposed between the flange section 5*a* and the peripheral portion of the upstream side end face 2*a* of the ceramic carrier 2 in such a manner that its outer peripheral surface is in contact with the inner peripheral surface of the cylindrical section 5*b* while its inner peripheral surface is in contact with the outer peripheral surface of the thin cylindrical section 5*c*. The cylindrical section 5*b* is fixedly secured at its outer peripheral surface to the inner peripheral surface of the container 1. It will be understood that the tip or free end of the thin cylindrical section 5*c* is separate from the upstream side end face 2*a* of the ceramic carrier 2.

The downstream side metal cap 6 is arranged similarly to the upstream side metal cap 5 and therefore has a generally annular flange section 6*a*, a generally cylindrical section 6*b* and a generally thin cylindrical section 6*c*, so that the downstream side cushioning material 8 is disposed between the annular flange section 6*a* and the peripheral portion of the downstream side end face 2*b* of the ceramic carrier 2 and between the cylindrical section 6*b* and the thin cylindrical section 6*c*. It will be understood that the flange and cylindrical sections 6*a*, 6*b* of the downstream side metal cap 6 correspond respectively to the flange and cylindrical sections 5*a*, 5*b* of the upstream side metal cap 5. It will be appreciated that these metal caps 5, 6 determine the location of the ceramic carrier 2 kept within the container 1.

Each of the upstream and downstream side cushioning material 7, 8 is formed of metal wire mesh and rolled up to be annular shaped and to be elastic. The upstream and downstream side cushioning materials 7, 8 elastically axially support the ceramic carrier 2 to prevent the ceramic carrier 2 from its axial movement, under incorporation with the metal caps 5, 6. The metal caps 5, 6 press respectively the cushioning materials 7, 8 and are fixed to the container 1 by plug welding, in a state that the ceramic carrier 2 is under a predetermined force or pressure through the cushioning materials 7, 8 from the metal caps 5, 6. More specifically, the plug welding is made between the container 1 and the cylindrical section 5*b*, 6*b* of the upstream and downstream side metal caps 5, 6, forming deposits 10 of welding metal in the holes 11 formed through the cylindrical wall of the container 1. Each metal deposit 10 is positioned at the extended portion Ep of the cylindrical section 5*b*, 6*b* of each metal cap 5, 6. This plug welding is made under a condition in which the metal caps 5, 6 are welded to the container 1 maintaining its pressing condition, so that the ceramic carrier 2 is encased within the container and is axially pressed at the step predetermined pressure.

Next, a method of producing the above-discussed catalytic converter C will be discussed with reference to FIGS. 2 and 3.

Figure 2:
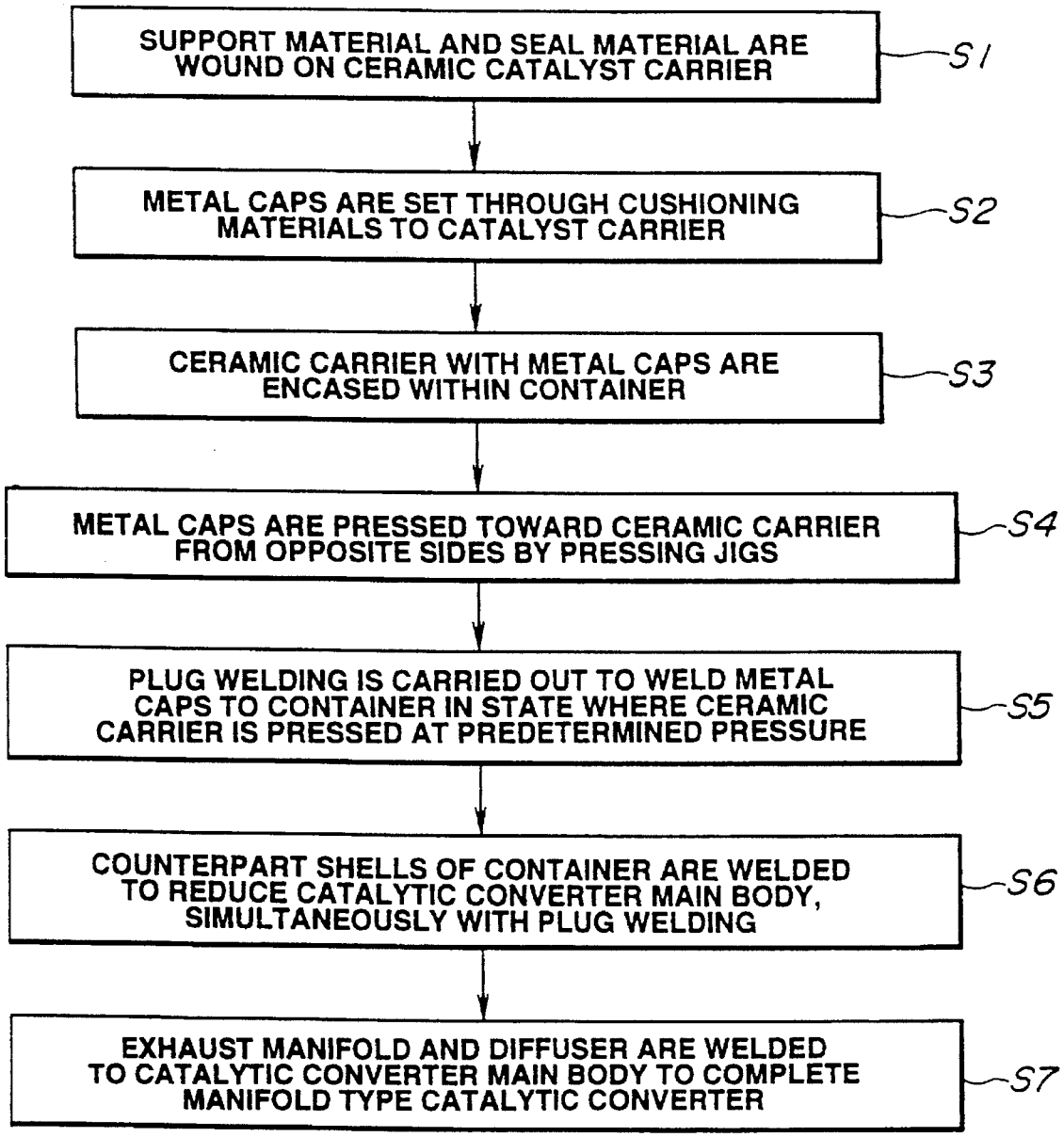
FIG. 2 is a flowchart showing a method of producing the catalytic converter of FIG. 1.

(a) The support material 3 and the thermally expandable seal material 4 are wound in parallel on the peripheral surface of the ceramic carrier 2 which has already carried thereon the catalytic material, as indicated at a step S1 in FIG. 2.

(b) The upstream and downstream side metal caps 5, 6 are respectively set at the opposite end sections of the ceramic carrier 2 with the support and seal materials 3, 4, disposing the upstream and downstream side cushioning materials 7, 8 at their positions at which they are respectively in contact with the peripheral portions of the upstream and downstream end faces 2*a*, 2*b* of the ceramic carrier 2, as indicated at a step S2 in FIG. 2. In this state, the extended portion Ep of the cylindrical section 5*b*, 6*b* of each metal cap 5, 6 extends inwardly over the end face 2*a*, 2*b* of the ceramic carrier 2 and is located over the cylindrical peripheral surface of the ceramic carrier 2.

(c) The ceramic carrier 2 along with the upstream and downstream side metal caps 5, 6 and the upstream and downstream side cushioning materials 7, 8 is encased within the container 1, as indicated at a step S3 in FIG. 2.

Figure 3:
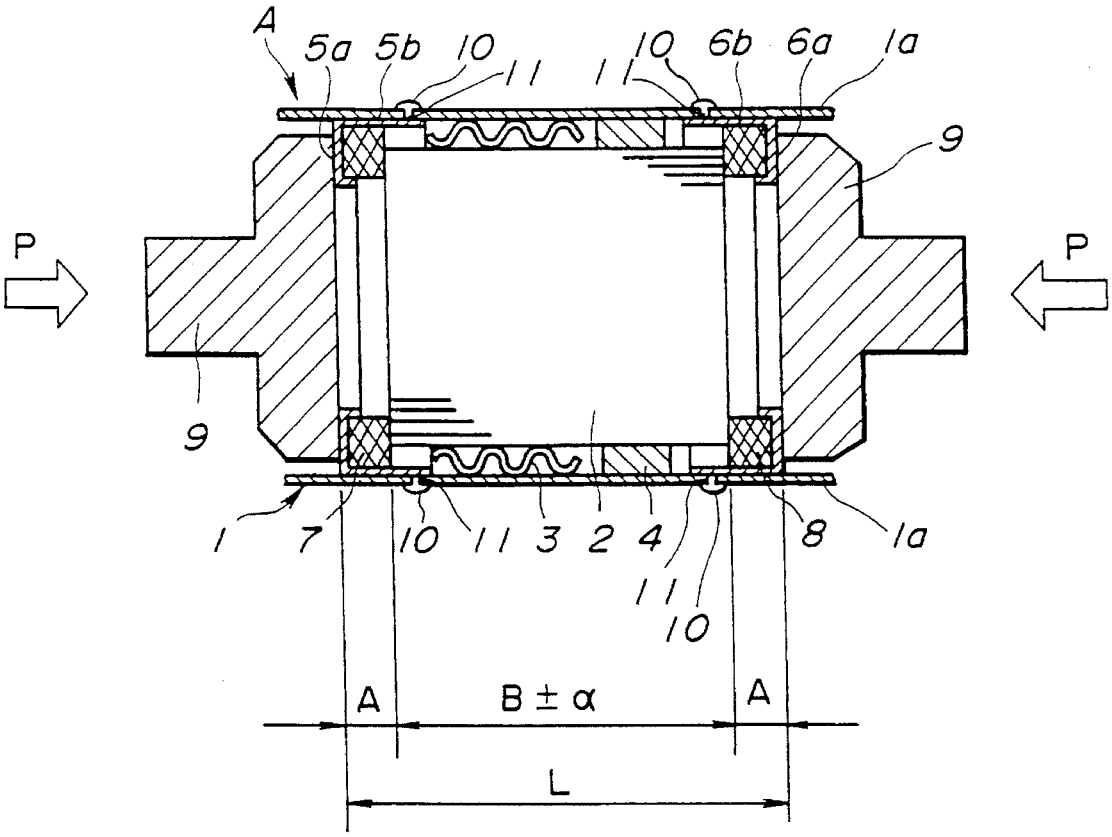
FIG. 3 is a vertical sectional view showing a step of the method for producing the catalytic converter of FIG. 1.

(d) A pair of pressuring jigs 9, 9 shown in FIG. 3 are pressed respectively on the metal caps 5, 6 at a predetermined pressure P shown in FIG. 3 in such a direction that the metal caps 5, 6 are pressed toward the ceramic carrier 2, as indicated at a step S4 in FIG. 2.

(e) Under pressing by the pressing jigs 9, 9, the ceramic carrier 2 is axially supported through the cushioning materials 7, 8 between the metal caps 5, 6 at the predetermined pressure P. In this state in which the predetermined pressure P is kept, the annular metal caps 5, 6 are welded to the container 1 by plug welding in which the metal deposits 10 are formed respectively in the holes 11 formed corresponding to the extended portions Ep of the metal caps 5, 6, as indicated at a step S5 in FIG. 2.

(f) Simultaneously with the above plug welding, the semi-cylindrical counterpart shells 1*a*, 1*a* of the container 1 are welded to each other to become cylindrical thereby producing the catalytic converter main body A, as indicated at a step S6 of FIG. 2.

(g) The exhaust manifold M and the diffuser D are welded to the catalytic converter main body A in such a manner that the exhaust manifold M is connected to the upstream side end portion of the container 1 whereas the diffuser D is connected to the downstream side end portion of the container 1, thus completing the catalytic converter C as shown in FIG. 1, as indicated at a step S7 in FIG. 2.

Subsequently, the function and operation of the above-discussed catalytic converter C will be discussed hereinafter.

Exhaust gas discharged from the engine flows through the exhaust manifold M into the catalytic converter main body A. Then, the exhaust gas passes through the gas passages (defined by passage walls carrying the catalytic material) formed in the ceramic carrier 2 and supplied to the diffuser D. The exhaust gas from the diffuser D is discharged through an exhaust pipe (not shown) into the atmospheric air. The noxious components of the exhaust gas are converted to harmless gases thereby purifying exhaust gas from the engine.

In the catalytic converter main body A, the ceramic carrier 2 is encased within the container 1 in a state to be axially pressed at the predetermined pressure by the metal caps 5, 6 and the cushioning materials 7, 8. Accordingly, the ceramic carrier 2 cannot become rickety within the container 1 under vibration caused by driving of the automotive vehicle, thereby preventing the ceramic carrier 2 from breaking or chipping off.

In production, the metal caps 5, 6 are respectively pressed toward the opposite end faces 2*a*, 2*b* of the ceramic carrier 2 under the action of the pressing jigs 9, 9 in a manner that the ceramic carrier 2 is axially maintain at the predetermined pressure through the cushioning materials 7, 8 between the metal caps 5, 6. In a state in which the predetermined pressure P is being maintained, the metal caps 5, 6 are plug-welded to the container (metal) 1. Accordingly, even if the length or axial dimension of the ceramic carrier 2 is not uniform throughout the products (catalytic converters C), the ceramic carrier 2 can be encased within the container 1 always in the state to be axially supported at a constant or predetermined pressure.

This will be explained more specifically with reference to FIG. 3 in which the whole length of an integer including the ceramic carrier 2, the metal caps 5, 6 and the cushioning materials 7, 8 is L; the dimension of the cushioning materials 7, 8 in contact with the catalytic carrier 2 under the predetermined or constant pressure P is F; the length or axial dimension of the ceramic carrier 2 is B; and the ceramic carrier 2 has an error $\pm\alpha$ in length or axial dimension relative to a standard length.

Figure 11:
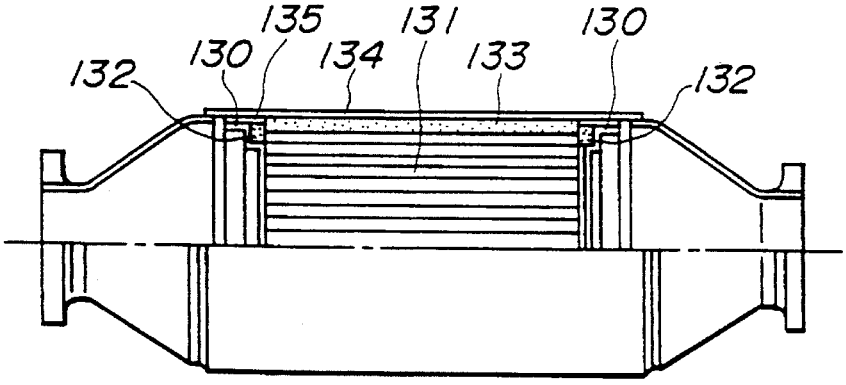
FIG.11 (PRIOR ART)
FIG. 11 is a front view, partly in section, of another conventional catalytic converter.
Figure 12:
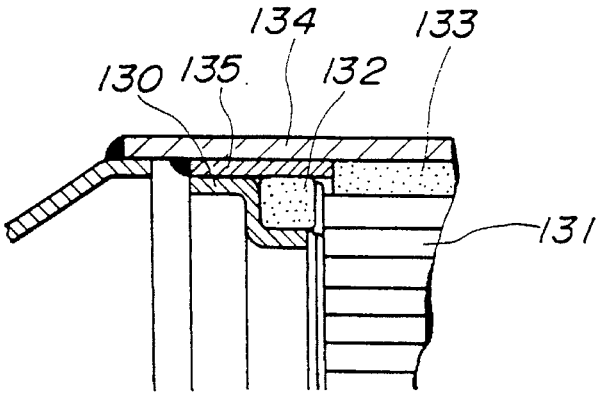
FIG.12 (PRIOR ART)
FIG. 12 is a fragmentary enlarged sectional view showing a part of the catalytic converter of FIG. 11.

Now, assume that the length or axial dimension of the ceramic carrier 2 is $B+\alpha$ (having the error of In this case, according to the conventional catalytic converter as shown in FIGS. 11 and 12 in which the locations of the metal caps (30, 30) are fixed throughout products (catalytic converters), the ceramic carrier (catalytic element) is encased within the container in a state pressurized excessively. This unavoidably lowers a vibration absorbing ability of the cushioning materials thereby providing the possibility of the ceramic carrier breaking or chipping off.

In contrast, assume that the length or axial dimension of the ceramic carrier 2 is $B-\alpha$ (having the error of $-\alpha$). In this case, according to the conventional catalytic converter as shown in FIGS. 11 and 12, the pressure for axially supporting the ceramic carrier (catalytic element) is insufficient so that the ceramic carrier will become rickety within the container, thus increasing the possibility of the ceramic carrier breaking or chipping off.

However, according to this embodiment of the catalytic converter C, even if the ceramic carrier 2 has the error $+\alpha$ in length or axial dimension B, the ceramic carrier 2 is encased within the container 1 always in the state to be axially supported at the predetermined or constant pressure P, so that the vibration absorbing ability for the ceramic carrier 2 is kept constant or at a predetermined level thereby effectively preventing the ceramic carrier 2 from breaking and chipping off.

Figure 4:
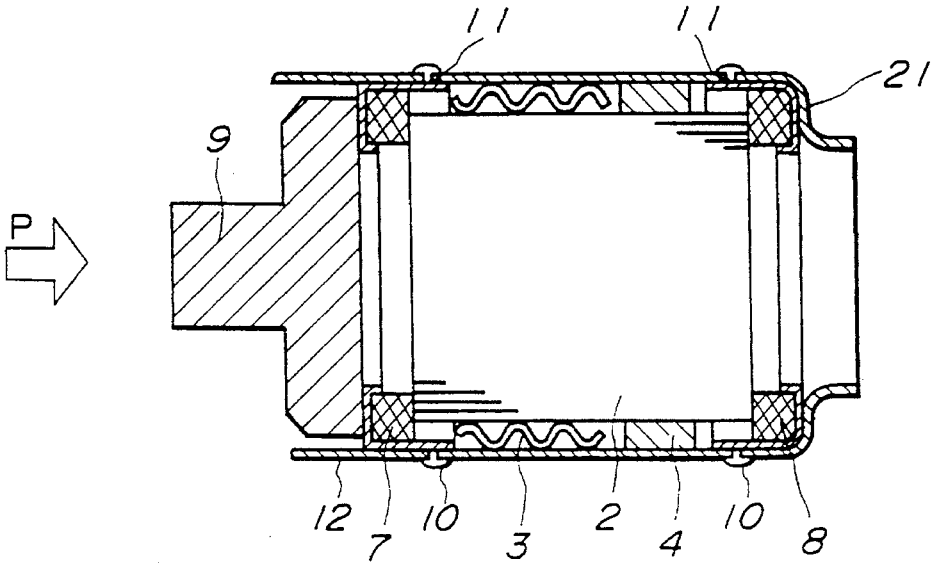
FIG. 4 is a vertical sectional view similar to FIG. 3 but showing a step of the method for producing a second embodiment of the catalytic converter according to the present invention.

FIG. 4 illustrates a second embodiment of the manifold type catalytic converter C according to the present invention, similar to the first embodiment of FIGS. 1 to 3.

The catalytic converter C of this embodiment is produced as follows: A converged section 21 is formed at the downstream end section of the container 1. The downstream side metal cap 6 is brought into contact with the converged section 21, so that only the upstream side metal cap 5 is pressed in the direction of the ceramic carrier 2 at the predetermined pressure P by the pressuring jig 9. Accordingly, the ceramic carrier 2 is supported at the predetermined pressure P through the cushioning materials 7, 8 between the metal caps 5, 6. In this state in which the predetermined pressure P is maintained, the metal caps 5, 6 are welded to the container 1 made of the metal by the plug welding in which the metal deposits 10 are formed in the holes 11 which are formed through the wall of the container 1 and located corresponding to the cylindrical section 5*b*, 6*b* of each metal cap 5, 6.

Figure 5:
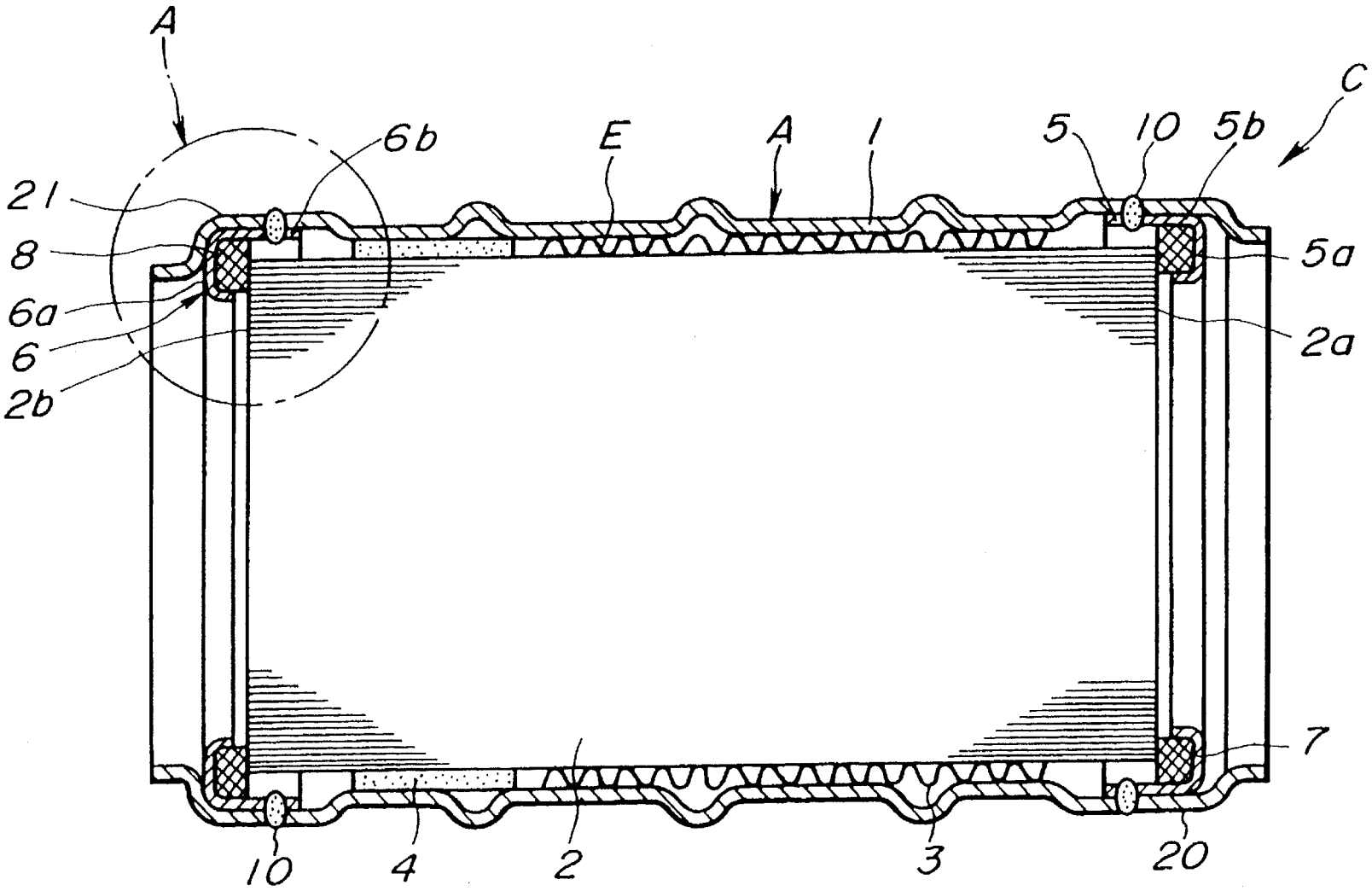
FIG. 5 is a vertical sectional view of a third embodiment of the catalytic converter in accordance with the present invention.
Figure 6:
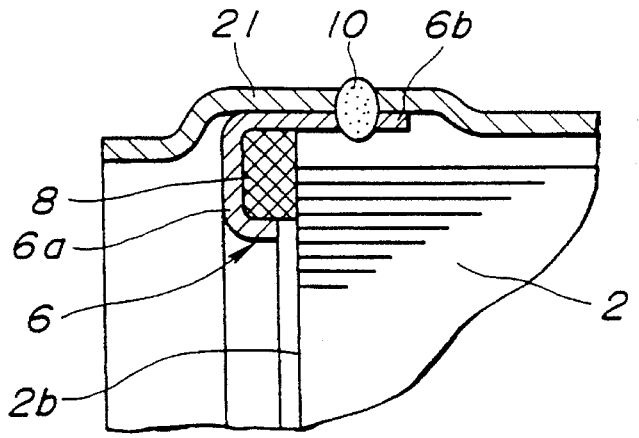
FIG. 6 is a fragmentary enlarged sectional view of a part encircled by a dot-dash line A in FIG. 5.
Figure 7:
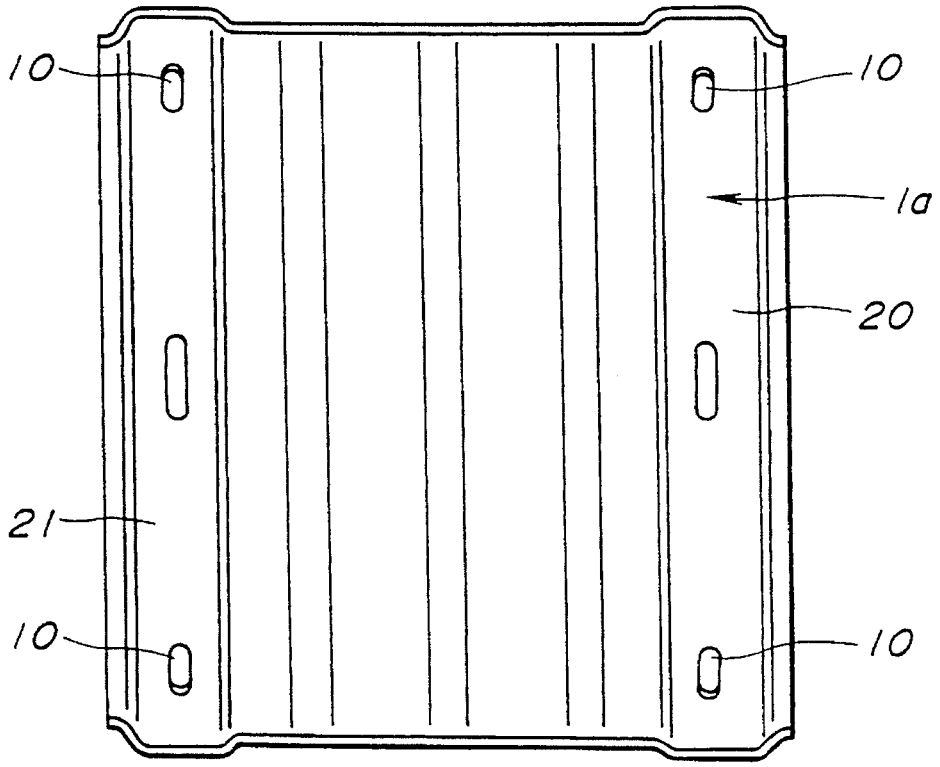
FIG. 7 is a side view of the catalytic converter of FIG. 5.

FIGS. 5, 6 and 7 illustrate a third embodiment of the manifold type catalytic converter C according to the present invention. This embodiment is similar to the first embodiment of FIGS. 1 to 3 except for the shape of the metal container 1. In this embodiment, the container 1 is formed with upstream and downstream side bulged sections 20, 21 which extend annularly along the periphery of the container 1 and radially bulge outward. The upstream and downstream side bulged sections 20, 21 are located respectively near the upstream and downstream side end faces 2*a*, 2*b* of the ceramic carrier 2. The upstream and downstream side caps 5, 6 are fitted and fixed to the inner surfaces of the upstream and downstream side bulged sections 20, 21 under plug welding, so that the holes 11 for metal deposits are formed through the wall of the bulged sections 20, 21.

With this arrangement, at the locations near the metal deposits 10 of the plug welding, the generally radial distance from the inner peripheral surface of the container 1 to the outer peripheral surface of the ceramic carrier 2 is enlarged, so that the back side beads or projections due to the metal deposits 10 cannot strike against the peripheral surface of the ceramic carrier 2 even under vibrations transmitted to the catalytic converter C. Accordingly, the ceramic carrier is effectively prevented from being broken by the back side projection due to the metal deposit 10, thus providing a high catalytic conversion efficiency of the catalytic converter C.

Additionally, the upstream and downstream side bulged sections 20, 21 contribute to increasing the strength of the generally cylindrical metal container 1, thereby preventing the container from being subjected to a thermal deformation. Particularly by virtue of the downstream side bulged section 21, the downstream side metal cap 6 is securely supported at its position so that the ceramic carrier 2 is prevented from dropping down from the container 1 even though the axis of the catalytic converter C is vertical.

While the upstream and downstream side bulged sections 20, 21 have been shown and described as being formed in the container 1 in this embodiment, it will be understood that at least one of them may be formed in the container 1.

Figure 8:
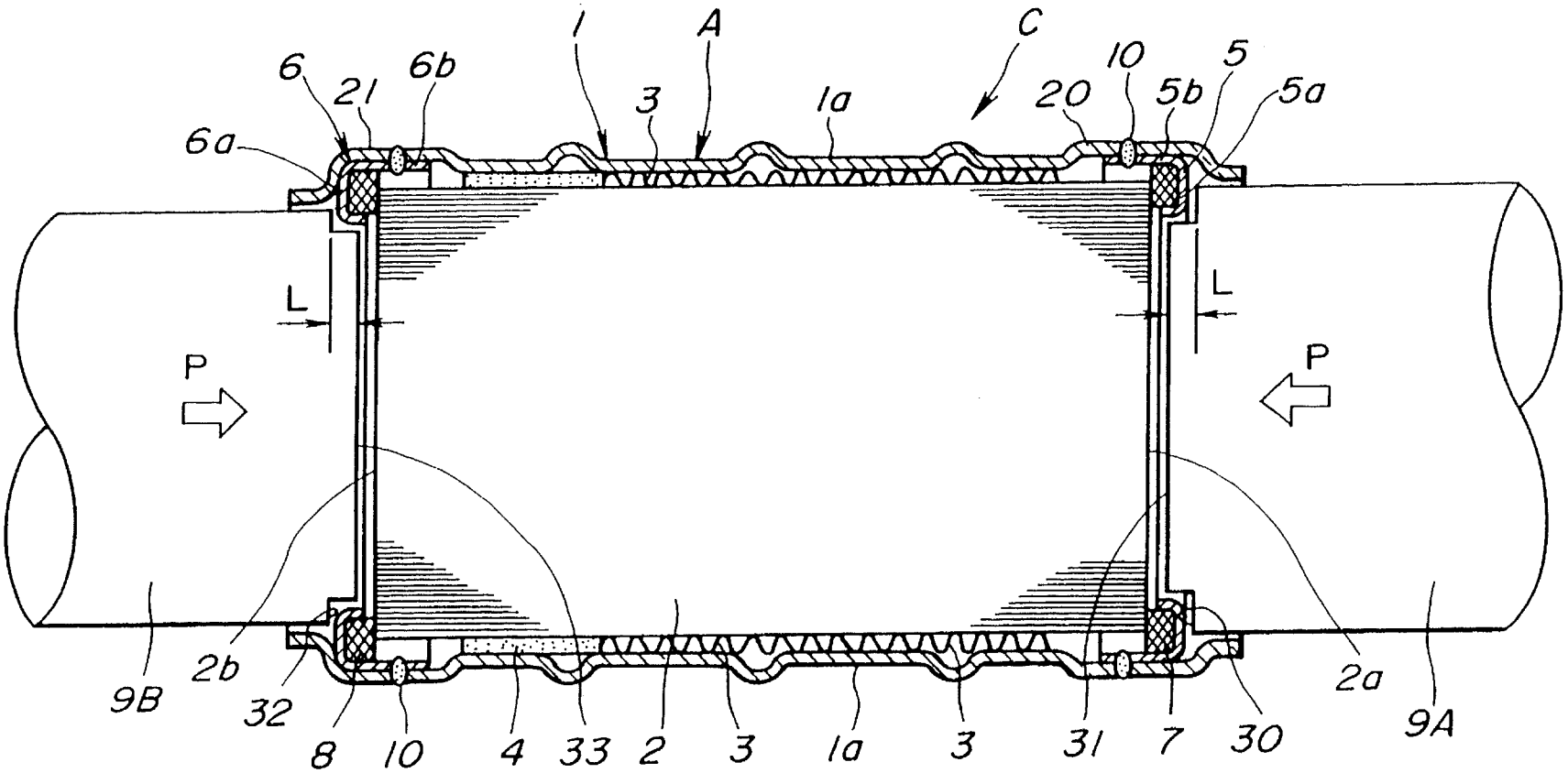
FIG. 8 is a vertical sectional view showing a step of a producing method of the catalytic converter of FIG. 5.

A method of producing the catalytic converter C of the third embodiment of FIGS. 5 to 7 will be discussed with reference to FIG. 8.

Upon setting, one the counterpart shells 1*a*, 1*a* of the container 1 is on the lower side. The annular caps 5, 6 are set at the opposite end faces 2*a*, 2*b* of the ceramic carrier 2 through the cushioning materials 7, 8. The support material 3 and the thermally expandable seal material 4 have been already wound on the ceramic carrier 2. Subsequently, the other counterpart shell 1*a* of the container is put on the counterpart shell 1*a* in a manner that flanges (not shown) of the respective counterpart shells 1*a*, 1*a* are brought into contact with each other. Then, the flanges are welded to form the generally cylindrical container in which the ceramic carrier 2 with the metal caps 5, 6 and the cushioning materials 7, 8 is disposed therein.

Under this state, pressures P are applied on the metal caps 5, 6 in the direction of the ceramic carrier 2 by the pressing jigs 9A, 9B. Then, plug welding is performed in a state in which each cushioning material 7, 8 is pressed by a predetermined amount or axial dimension between the end face 2*a*, 2*b* of the ceramic carrier 2 and the annular flange section 5*a*, 6*a* of the metal cap 5, 6.

The pressing jig 9A is located near the end face 2*a* of the ceramic carrier 2 and includes a generally annular cap pressing surface 30 which is brought into contact with and presses the metal cap 5, and a generally circular carrier pressing surface 31 which is brought into contact with and presses the end face 2*a* of the carrier 2. The carrier pressing surface 31 projects from the cap pressing surface 30 by a distance L in the axial direction of the ceramic carrier 2. The cap and carrier pressing surfaces 30, 31 are parallel and coaxial with each other. Similarly, the pressing jig 9B is located near the end face 2*b* of the ceramic carrier 2 and includes a generally annular cap pressing surface 32 which is brought into contact with and presses the metal cap 6, and a generally circular carrier pressing surface 33 which is brought into contact with and presses the end face 2*b* of the carrier 2. The carrier pressing surface 33 projects from the cap pressing surface 32 by a distance L (the same distance as in the jig 9A) in the axial direction of the ceramic carrier 2. The cap and carrier pressing surfaces 32, 33 are parallel and coaxial with each other. It will be understood that a pressure corresponding to the distance L is applied to the cushioning material 7, 8 and therefore to the peripheral portion of the end face 2*a*, 2*b* of the ceramic carrier 2.

With the above producing method, even if the ceramic carrier 2 has an error in its axial dimension or has a non-uniform axial dimension throughout products (ceramic carriers), a predetermined or constant supporting force (pressure) is axially applied to the ceramic carrier 2 through the metal caps 5, 6 and the cushioning materials 7, 8, thereby allowing scattered axial dimensions of the produced ceramic carriers 2.

Additionally, the pressing jigs 9A, 9B have the same distance L and therefore the compressed amounts of the cushioning materials 7, 8 are the same thereby more securely supporting the ceramic carrier 2 within the container 1.

While only the catalyst carrier 2 made of ceramic has been shown and described, it will be understood that the principle of the present invention may be applied to catalytic converters including a catalyst carrier made of metal.

Although the container 1 has been shown and described as being constituted of two counterpart shells 1*a*, 1*a*, it will be appreciated that the container may be cylindrical and have a one-piece structure.

Otherwise, the catalytic converter C may be assembled as follows: The ceramic carrier 2 is inserted into the cylindrical container 1 provided with one annular metal cap 5 fixed at one end section of the container 1. One cushioning material 7 is disposed between the one end face of the carrier 2 and the metal cap 8. Then, the other metal cap 6 is set through the other cushioning material 8 at the other end face of the carrier 2. Thereafter, pressures are respectively applied from the axial outsides to the annular metal caps 5, 6. Under this pressurized state of the cushioning materials 7, 8, plug welding is made to weld the annular metal caps 5, 6 to the metal container 1.

Figure 9:
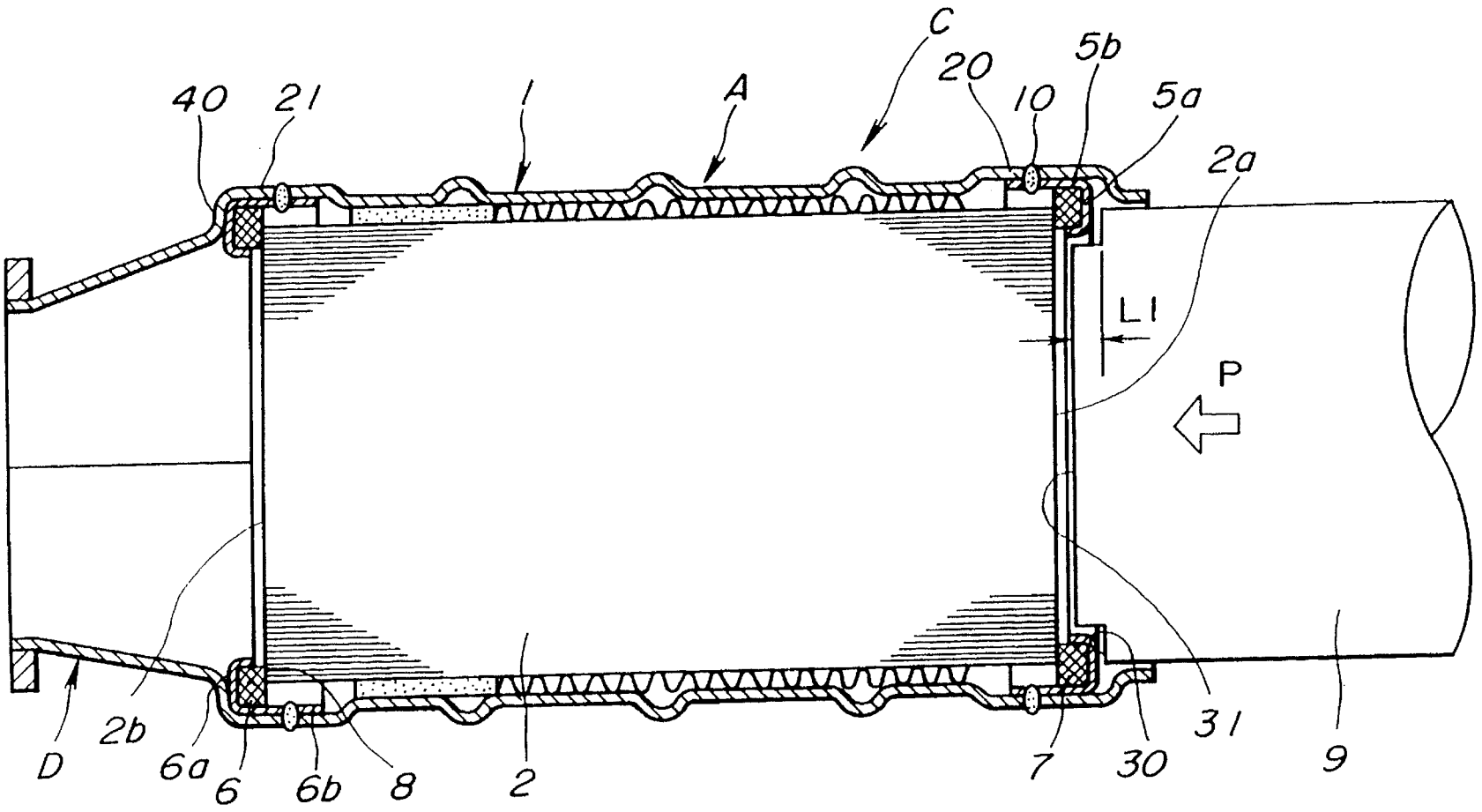
FIG. 9 is a vertical section view showing a step in the method for producing a fourth embodiment of the catalytic converter according to the present invention.
Figure 10:
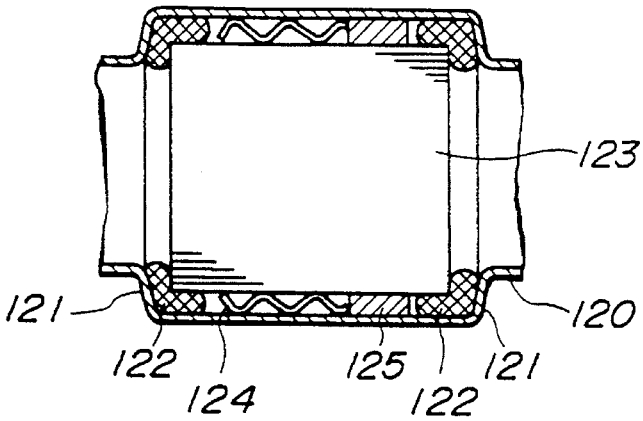
FIG.10 (PRIOR ART)
FIG. 10 is a sectional view of a conventional catalytic converter.

FIG. 9 illustrates a fourth embodiment of the manifold type catalytic converter C of the present invention, which is similar to the third embodiment of FIGS. 5 to 8. In this embodiment, the container 1 is formed with a converged section 40 near the end face 2*b* of the ceramic carrier 2. The metal cap 5 is in contact with the inner surface of the converged section 40. The ceramic carrier 2 is supported at its end face to the metal cap 5 through the cushioning material 7. The metal cap 6 is set through the cushioning material 8 to the end face 2*b* of the ceramic carrier 2.

The pressing jig 9 applies pressure to the metal cap 6 as shown in FIG. 9. In this state, plug welding is made to weld the metal cap 6 to the container 1. The pressing jig 9 includes a generally annular cap pressing surface 30 which is brought into contact with and presses the metal cap 7, and a generally circular carrier pressing surface 31 which is brought into contact with and presses the end face 2*a* of the carrier 2. The carrier pressing surface 31 projects from the cap pressing surface 30 by a distance L1 in the axial direction of the ceramic carrier 2. The cap and carrier pressing surfaces 30, 31 are parallel and coaxial with each other.

While only the manifold type catalytic converters have been shown and described, it will be understood that the principle of the present invention may be applied to catalytic converters of so-called under-floor type to be disposed under the floor of an automotive vehicle. Additionally, it will be appreciated that the principle of the present invention may be applied to catalytic converters for a variety of internal combustion engines which are other than those of an automotive vehicle.

What is claimed is:

1. A method of producing a catalytic converter, comprising:

winding a support material made of metal wire mesh and a thermally expandable seal material on a catalyst carrier made of a ceramic and carrying a catalytic material;

disposing first and second cushioning materials respectively at peripheral portions of opposite end faces of said ceramic carrier;

attaching first and second annular metal end caps respectively to the first and second cushioning materials so as to be located axially outside of said first and second cushioning materials, each metal cap having an annular flange section facing the peripheral portion of the end face of said ceramic carrier, and a cylindrical section integral with said flange section;

encasing said ceramic carrier within a container made of a metal;

pressing said first and second annular metal caps toward said ceramic carrier by using a pressing jig in a manner to apply a predetermined pressure to said ceramic carrier in an axial direction so that said predetermined pressure is constant throughout a plurality of ceramic carriers having different axial dimensions;

maintaining said ceramic carrier in a state to be axially supported at said predetermined pressure through said first and second cushioning materials between said first and second metal caps; and plug welding said first and second metal end caps to said container, while maintaining said predetermined pressure.

2. A method as claimed in claim 1, wherein each cushioning material is formed of a metal wire mesh and formed annular, said annular cushioning material being located between the flange section of said metal cap and the peripheral portion of the end face of said ceramic carrier.

3. A method as claimed in claim 1, wherein the cylindrical section of each metal cap extends inwardly over the end face of said ceramic carrier and located over a peripheral surface of said ceramic carrier.

4. A method as claimed in claim 1, further comprising forming a plurality of holes through a wall of said container, said holes being located corresponding to said metal caps, a metal deposit being formed in each hole.

5. A method as claimed in claim 2, wherein each metal cap having the flange section and the cylindrical section is generally L-shaped in cross-section.

6. A method as claimed in claim 1, wherein said pressing jig includes a first pressing jig having a first pressing surface contactable with one end face of said ceramic carrier, and a second pressing surface contactable with the first metal cap, said first pressing surface projecting in the direction of said ceramic carrier by a predetermined distance from said second pressing surface.

7. A method as claimed in claim 6, wherein said pressing jit further including a second pressing jig having a third pressing surface contactable with the other end face of said ceramic carrier, and a fourth pressing surface contactable with the second metal cap, said third pressing surface projecting in the direction of said ceramic carrier by a predetermined distance from said fourth pressing surface.

8. A method as claimed in claim 6, further comprising setting said first pressing jig coaxially with said ceramic carrier before the pressing step.

9. A method of producing a plurality of catalytic converters, at least two of said plurality of catalytic carriers have catalyst carriers which have different axial lengths, comprising:

producing a first catalytic converter which includes a first catalyst carrier having a first axial length, comprising the steps of:

winding a support material made of metal wire mesh and a thermally expandable seal material on the first catalyst carrier made of a ceramic and carrying a catalytic material;

disposing first and second cushioning materials respectively at peripheral portions of opposite end faces of the first ceramic carrier;

attaching first and second annular metal end caps respectively to the first and second cushioning materials so as to be located axially outside of the first and second cushioning materials, each metal cap having an annular flange section facing the peripheral portion of the end face of the first ceramic carrier, and a cylindrical section integral with said flange section;

encasing said first ceramic carrier within a container made of a metal;

pressing first and second annular metal caps toward said first ceramic carrier by using a pressing jig in a manner to apply a predetermined pressure to said first ceramic carrier in an axial direction in accordance with an axial dimension of said first ceramic carrier;

maintaining said first ceramic carrier in a state to be axially supported at said predetermined pressure through said first and second cushioning materials between said first and second metal caps; and carrying out plug welding to weld said first and second metal end caps to said container, while maintaining said predetermined pressure;

producing a second catalytic converter which includes a second catalytic carrier having a second axial length, which comprises substantially the same steps for producing said first catalytic converter, wherein the predetermined pressure applied in the production of the first and second catalytic converter is substantially content.

* * * * *